US012089736B2

(12) United States Patent
Knicker et al.

(10) Patent No.: US 12,089,736 B2
(45) Date of Patent: Sep. 17, 2024

(54) FITTING FOR SECURING A WALL-MOUNTED FURNITURE PIECE TO A WALL, AND WALL-MOUNTED FURNITURE PIECE

(71) Applicant: PAUL HETTICH GMBH & CO. KG, Kirchlengern (DE)

(72) Inventors: Henrik Knicker, Bünde (DE); Steffen Tenhumberg, Osnabrück (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 868 days.

(21) Appl. No.: 16/972,161

(22) PCT Filed: Jun. 3, 2019

(86) PCT No.: PCT/EP2019/064331
§ 371 (c)(1),
(2) Date: Dec. 4, 2020

(87) PCT Pub. No.: WO2019/233943
PCT Pub. Date: Dec. 12, 2019

(65) Prior Publication Data

US 2021/0235864 A1 Aug. 5, 2021

(30) Foreign Application Priority Data

Jun. 5, 2018 (DE) ..... 20 2018 103 146.5

(51) Int. Cl.
*A47B 51/00* (2006.01)
*A47B 95/00* (2006.01)

(52) U.S. Cl.
CPC ..... *A47B 51/00* (2013.01); *A47B 95/008* (2013.01)

(58) Field of Classification Search
CPC ..... A47B 51/00; A47B 95/008
See application file for complete search history.

(56) References Cited

U.S. PATENT DOCUMENTS 2,854,307 A * 9/1958 Londeree ..... A47B 77/04 312/247
6,471,311 B1 10/2002 Snyder
(Continued)

FOREIGN PATENT DOCUMENTS

DE 3409990 A1 7/1984
DE 102016122044 A1 5/2018
(Continued)

OTHER PUBLICATIONS

International Search Report mailed on Jul. 26, 2019 in related/corresponding International Application No. PCT/EP2019/064331.
(Continued)

*Primary Examiner* — James O Hansen
(74) *Attorney, Agent, or Firm* — PATENT PORTFOLIO BUILDERS PLLC

(57) ABSTRACT

A fitting for securing a wall-mounted furniture piece, in particular a wall-mounted cabinet, on a wall is provided. The wall-mounted furniture piece has a furniture body with at least one base, a lateral wall, and a rear wall. The fitting has a first fitting part that can be secured to the wall, a second fitting part that can be secured to the wall-mounted furniture piece, and a drive unit having an adjustable length and via which the first fitting part and the second fitting part are interconnected. A support element is arranged between the first fitting part and the rear wall or a contact surface situated towards the rear of a wall-mounted furniture piece.

4 Claims, 10 Drawing Sheets

(56) References Cited

U.S. PATENT DOCUMENTS

Figure 1:
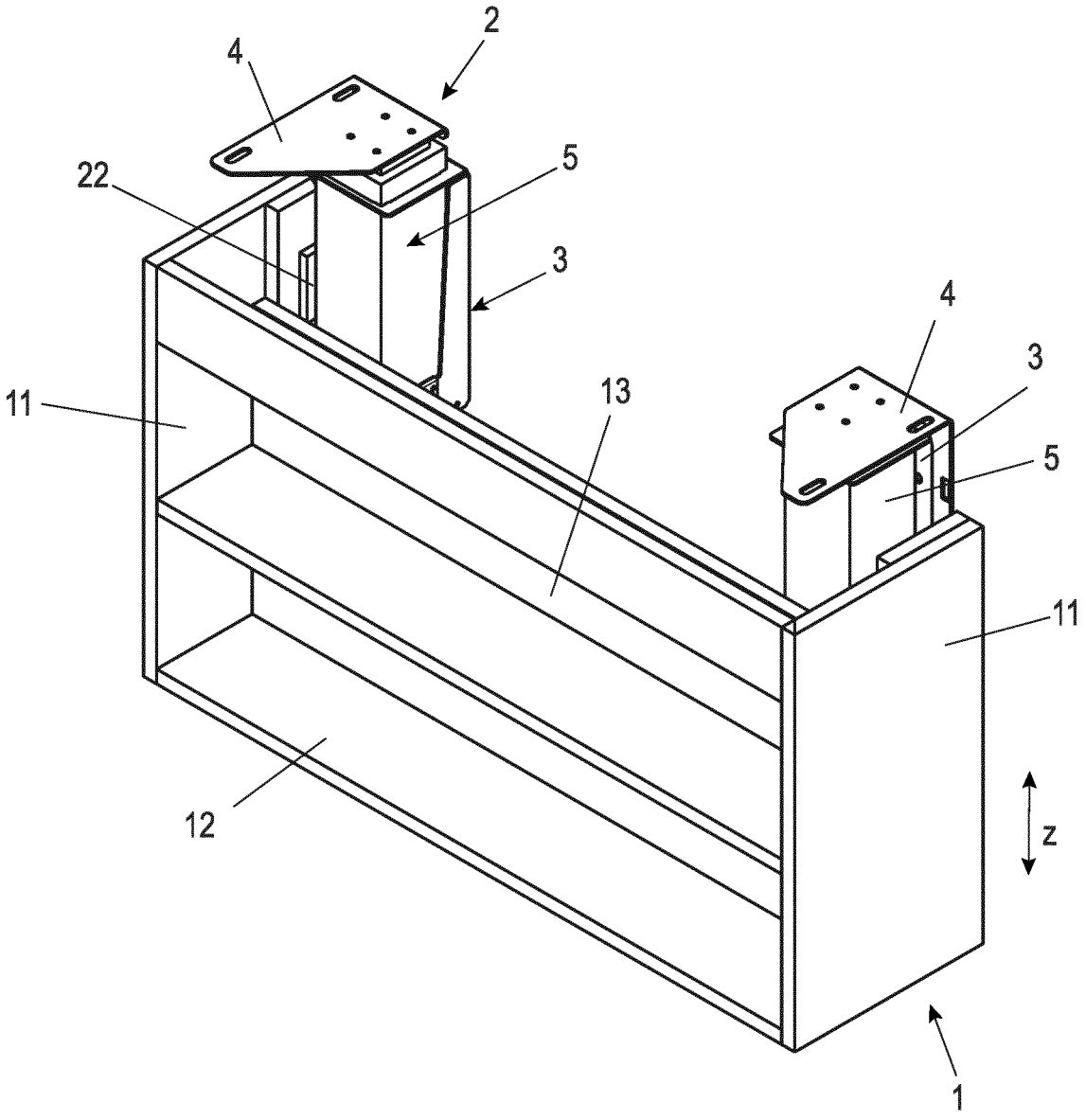

| | | | | |
|---|---|---|---|---|
| 9,375,081 | B2 * | 6/2016 | Messing | A47B 51/00 |
| 9,759,374 | B1 | 9/2017 | Lair | |
| 2006/0066188 | A1 * | 3/2006 | Crawford | A47B 51/00<br>312/247 |
| 2017/0303683 | A1 | 10/2017 | Guivol et al. | |

FOREIGN PATENT DOCUMENTS

| | | | | |
|---|---|---|---|---|
| EP | 0402283 | * | 12/1990 | A47B 51/00 |
| FR | 2783142 | A1 | 3/2000 | |
| JP | S63197427 | U | 12/1988 | |
| JP | H0680710 | U | 11/1994 | |
| JP | H11206474 | A | 8/1999 | |
| JP | 2001161467 | A | 6/2001 | |
| WO | 2007003012 | A1 | 1/2007 | |
| WO | 2015035435 | A1 | 3/2015 | |
| WO | 2015193895 | A2 | 12/2015 | |

OTHER PUBLICATIONS

Written Opinion mailed on Jul. 26, 2019 in related/corresponding International Application No. PCT/EP2019/064331.
Office Action dated Jun. 13, 2023 in related/corresponding JP Application No. 2020-567778.

* cited by examiner

FITTING FOR SECURING A WALL-MOUNTED FURNITURE PIECE TO A WALL, AND WALL-MOUNTED FURNITURE PIECE

BACKGROUND AND SUMMARY OF THE INVENTION

Exemplary embodiments of the present invention relate to a fitting for securing a wall-mounted furniture piece to a wall according and a wall-mounted furniture piece.

Such fittings, which can also be used to attach wall-mounted furniture pieces such as wall-mounted cabinets or wall units to a wall, are usually fixed on the furniture side to the rear of the furniture piece and detachable from the wall using hooks or hanging rails.

In order to be able to variably adjust the mounting height of the wall-mounted furniture piece to a height suitable for the user, an adjustable fitting is known from DE 10 2016 122 044 A1, for example, in which a first fitting part is fixed to the wall and a second fitting part to the wall-mounted furniture piece, wherein the two fitting parts are connected to each other via a length-adjustable drive unit.

Such a fitting has proven itself in practice.

One problem that has been found to be problematic is that during height adjustment of the wall-mounted furniture piece, unwanted contact of the wall-mounted furniture piece with the wall can occur, which can lead to damage to the wall and/or the wall-mounted furniture piece.

Exemplary embodiments of the present invention are directed to a fitting for securing a wall-mounted furniture piece as well as a wall-mounted furniture piece which prevents damage to the wall and/or the wall-mounted furniture piece.

The fitting in accordance with the invention for securing a wall-mounted furniture piece, in particular a wall-mounted cabinet, to a wall, in which the wall-mounted furniture piece has a furniture body with at least one base, a lateral wall and a rear wall, has a first fitting part that can be secured to the wall, a second fitting part that can be secured to the wall-mounted furniture piece and a length-adjustable drive unit, via which the first fitting part and the second fitting part are interconnected.

A support element is arranged between the first fitting part and the rear wall or a contact surface of the wall-mounted furniture piece arranged towards the rear region of the wall-mounted furniture piece.

By placing such a support element between the rear part of the wall-mounted furniture piece and the first fitting part of the fitting, contact with a rear part of the wall-mounted furniture piece is effectively prevented when the wall-mounted furniture piece is moved in a vertical direction to adjust the height of the wall-mounted furniture piece.

According to an advantageous embodiment variant, the support element is designed as a sliding element or rolling element, in particular as a rolling element.

This enables a low-friction movement of the wall-mounted furniture piece to adjust its height.

According to another advantageous embodiment variant, the support element is adjustably arranged orthogonally to the wall in a support direction on the first fitting part or the rear wall.

The adjustability of the support element in the support direction makes it possible to adjust the tilt of the wall unit after height adjustment.

The support element is attached to the first fitting part according to a preferred first embodiment variant.

The first fitting part has particularly preferred a first lateral wall that can be fixed to the wall and a second lateral wall extending perpendicular thereto, on which the support element is arranged.

On this second lateral wall, preferably a sliding holder is slidably attached, to which the support element is attached.

This allows a simple arrangement of a support element that can be adjusted in the support direction.

According to an alternative embodiment variant, the support element is attached to the rear wall of the wall-mounted furniture piece and accordingly faces towards the first fitting part.

The support element is preferably accommodated in a retaining element attached to the rear wall.

This retaining element preferably has an adjustment unit for variable positioning of the support element in the support direction.

According to another preferred embodiment variant, the drive unit is designed as an electromechanical lifting column, with which the height of the wall-mounted furniture piece can be easily adjusted.

It is also conceivable, in accordance with an alternative embodiment variant, to provide the drive unit with an energy storage device and a latching or locking unit designed as a latching fitting.

This allows a simple, mechanically operated height adjustment of the wall-mounted furniture piece.

The wall-mounted furniture piece according to the invention is characterized by at least one fitting as described above.

BRIEF DESCRIPTION OF THE DRAWING FIGURES

Figure 2:
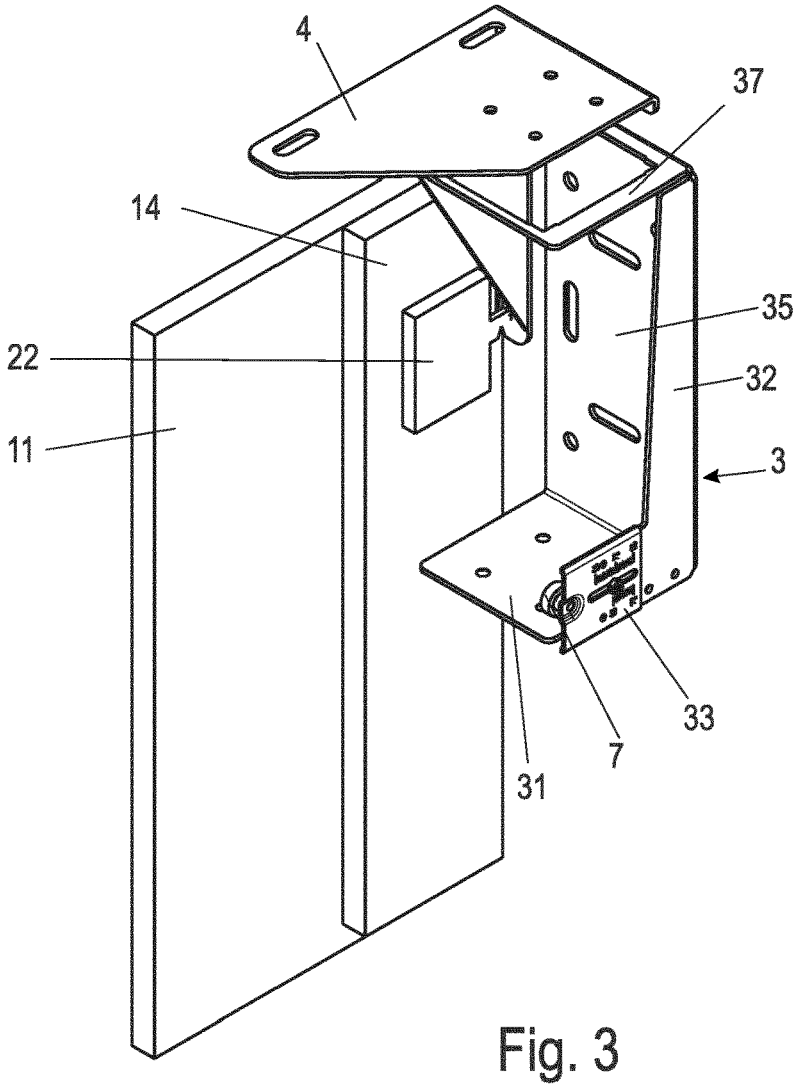
Figure 3:
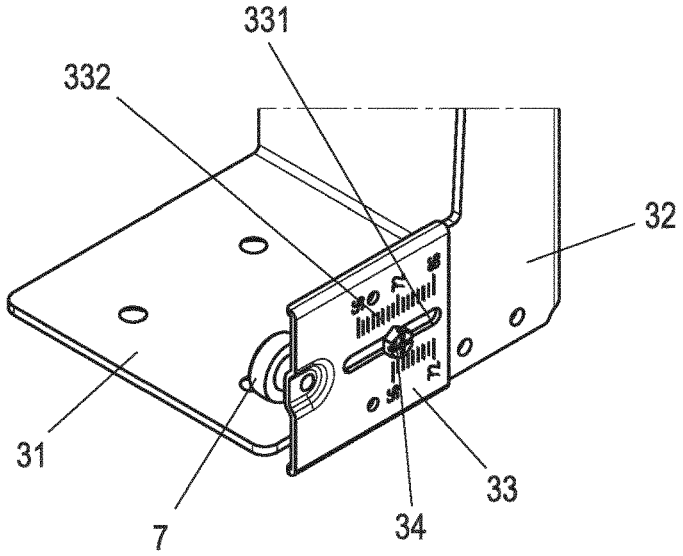
Figure 5:
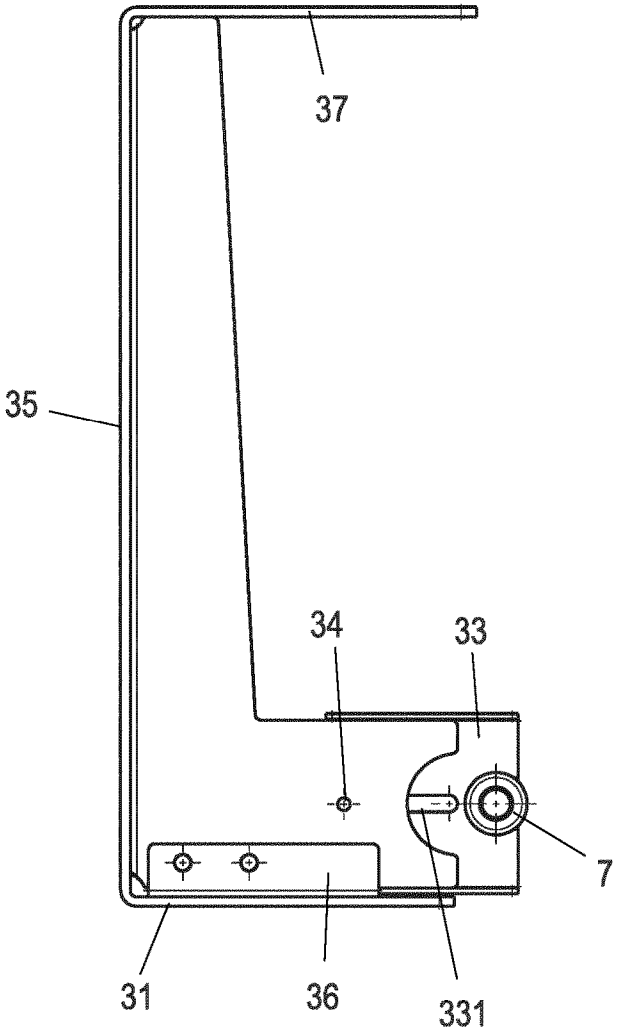
Figure 4:
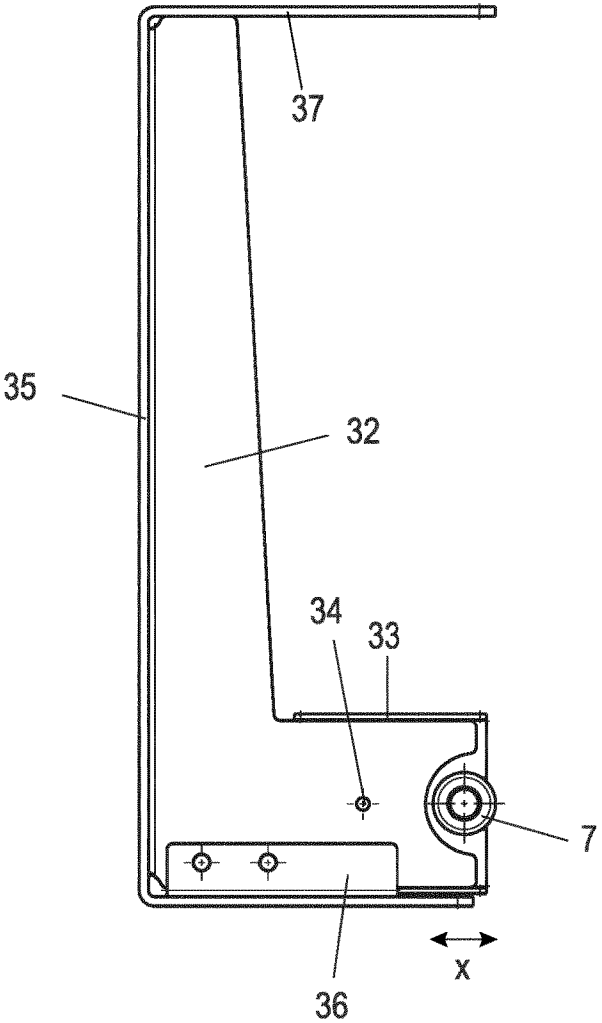
Figure 6:
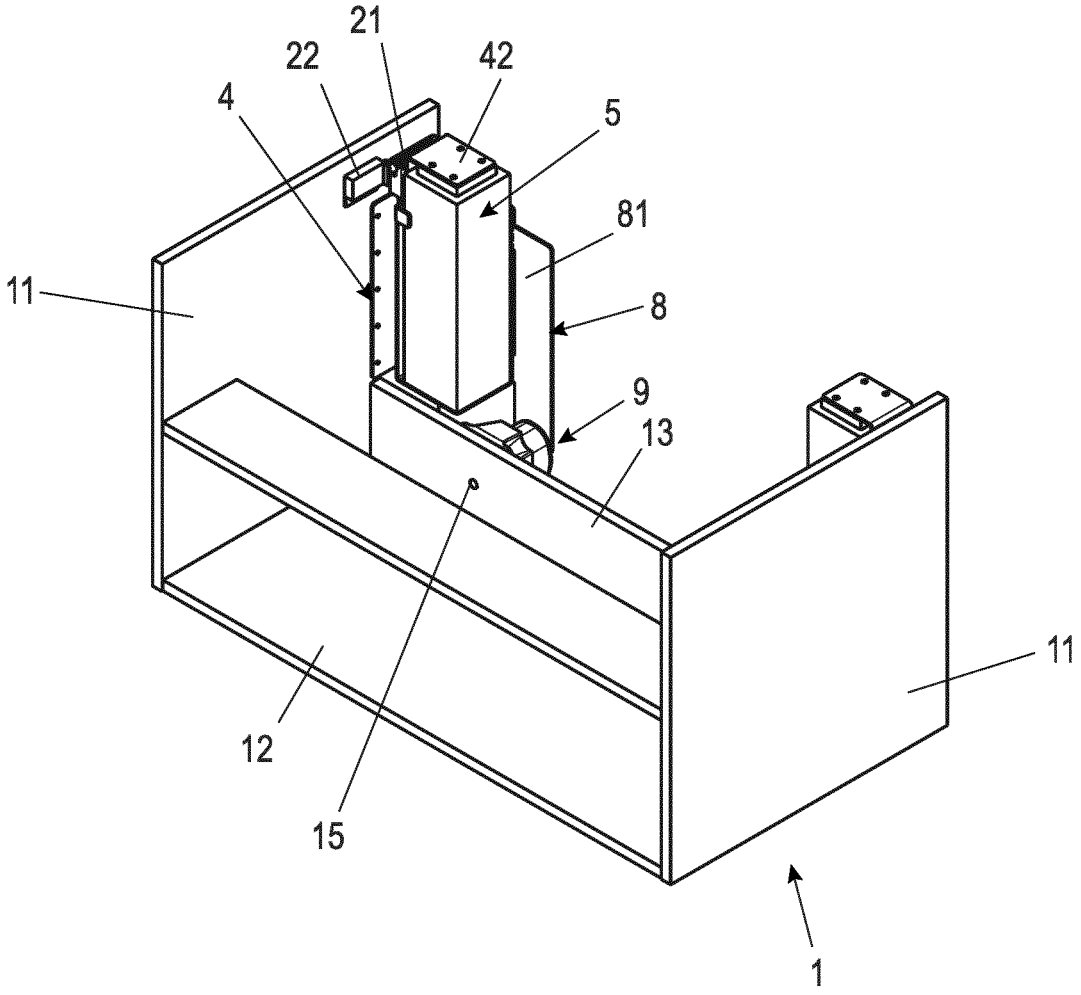
Figure 7:
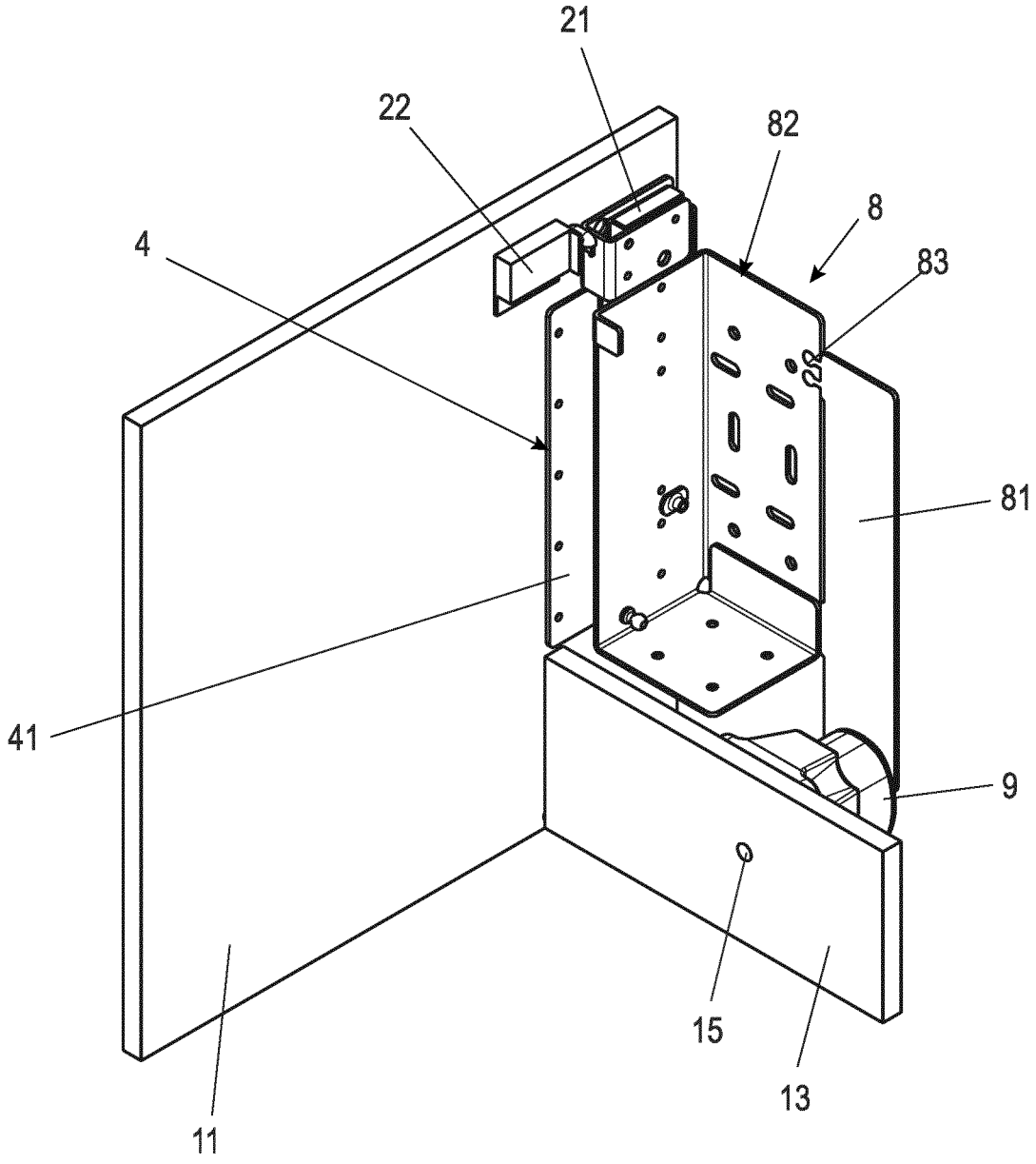

In the following, exemplary embodiments of the invention are explained in more detail using the enclosed drawings, wherein:

FIG. 1 shows a perspective view of an embodiment variant of a wall-mounted furniture piece with two fittings attached thereto, FIG. 2 shows a perspective view of the lateral wall of the wall-mounted furniture piece from FIG. 1 and a fitting attached to it with omitted drive unit, FIG. 3 shows a perspective detail view of a section of the first fitting part with the sliding holder attached thereto, FIGS. 4 and 5 show side views of the first fitting part with differently positioned sliding holder, FIG. 6 shows a perspective view of an alternative embodiment variant of fittings attached to a wall-mounted furniture piece, FIG. 7 shows a perspective detail view of the fitting components of the fitting as shown in FIG. 6, arranged on a lateral wall and a rear wall of the wall-mounted furniture piece.

Figure 8:
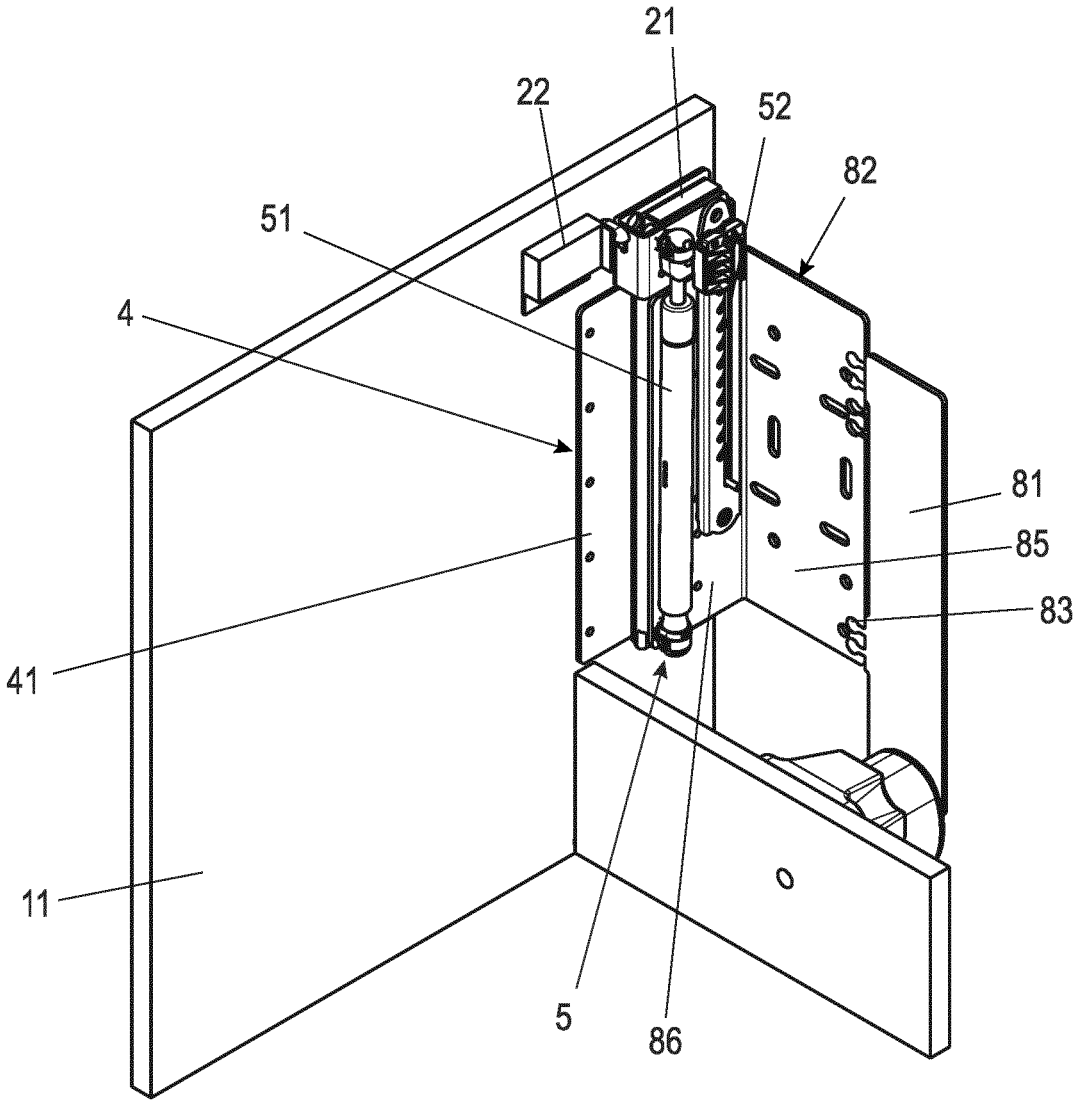
Figure 9:
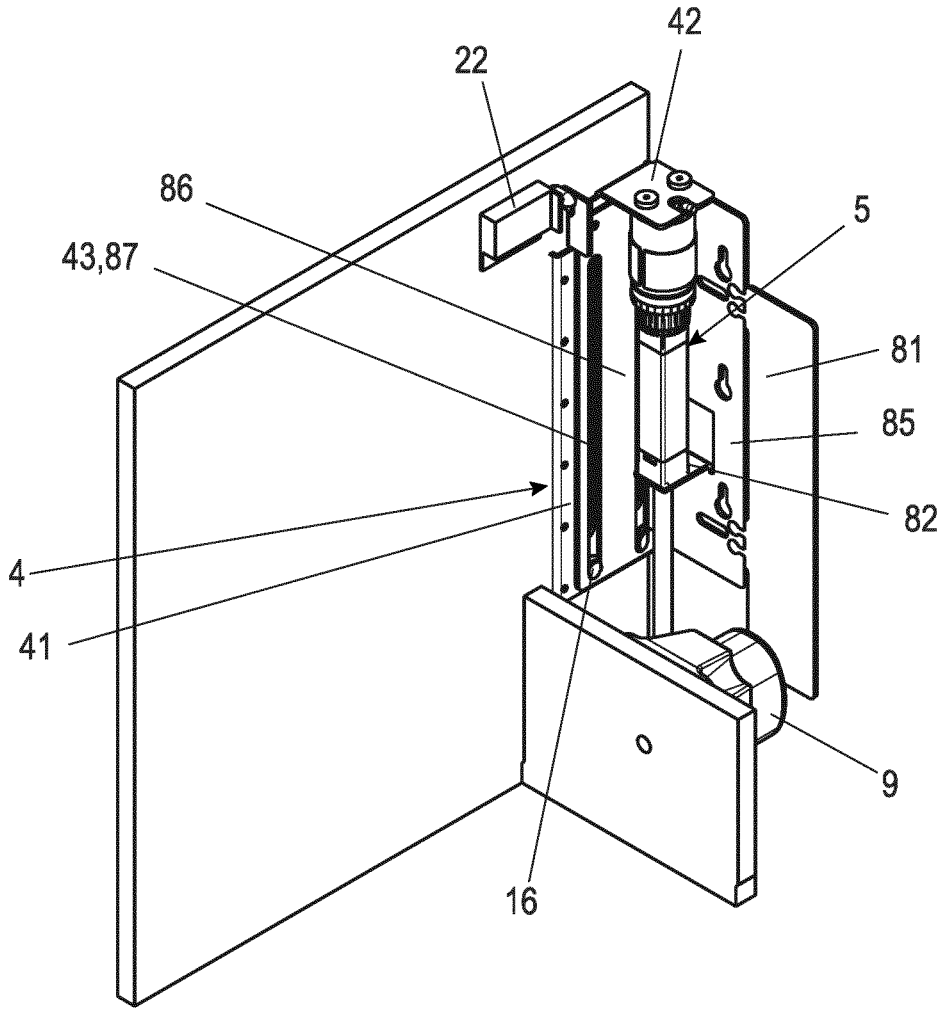

FIGS. 8 and 9 show perspective views corresponding to FIG. 7 with alternatively designed drive units.

Figure 10:
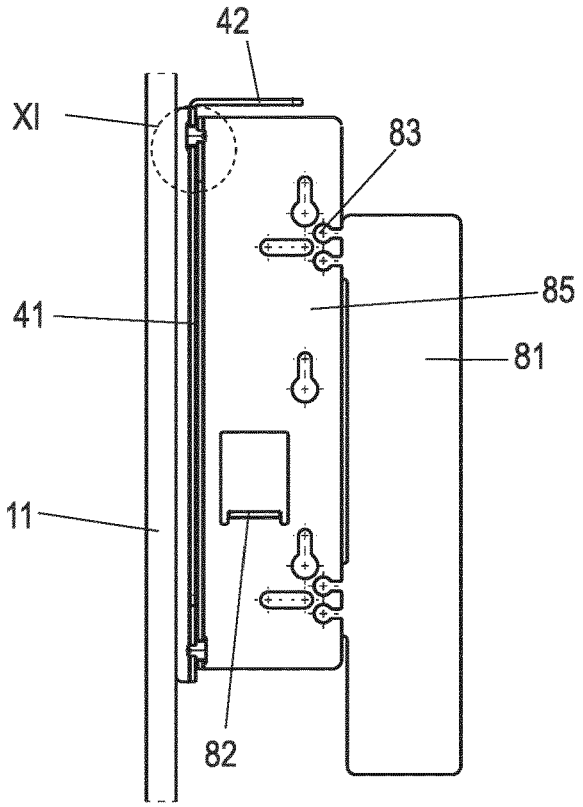
Figure 11:
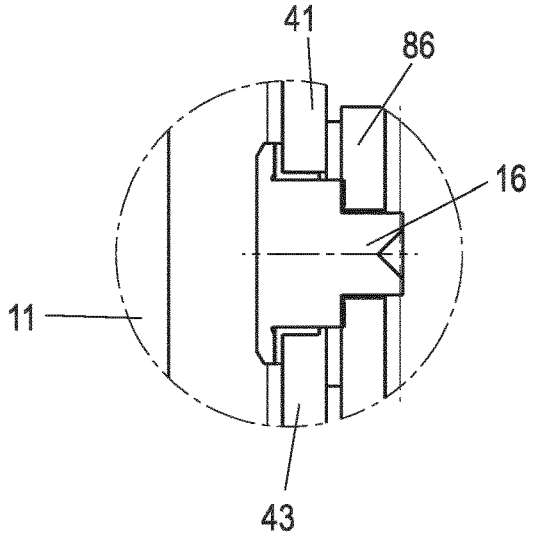
Figure 13:
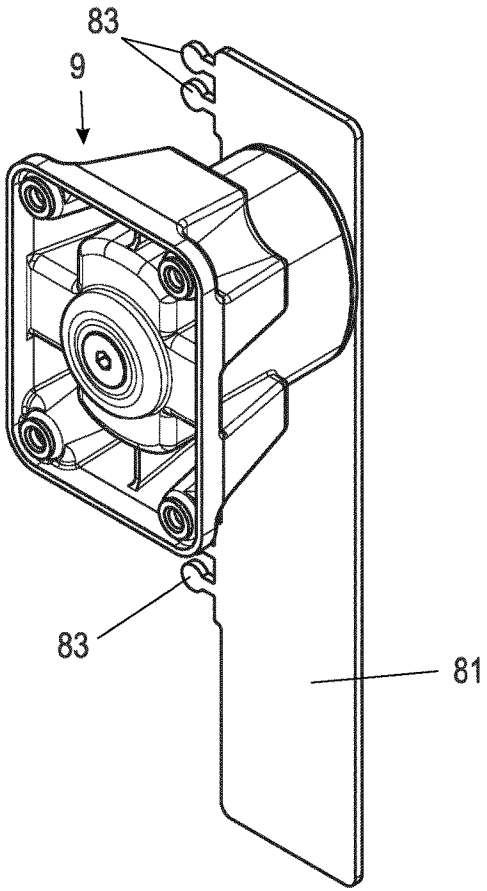
Figure 12:
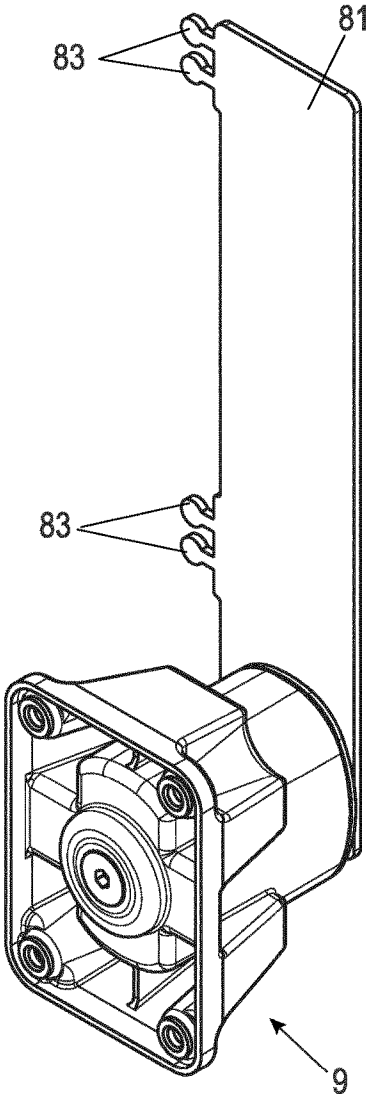
Figure 14:
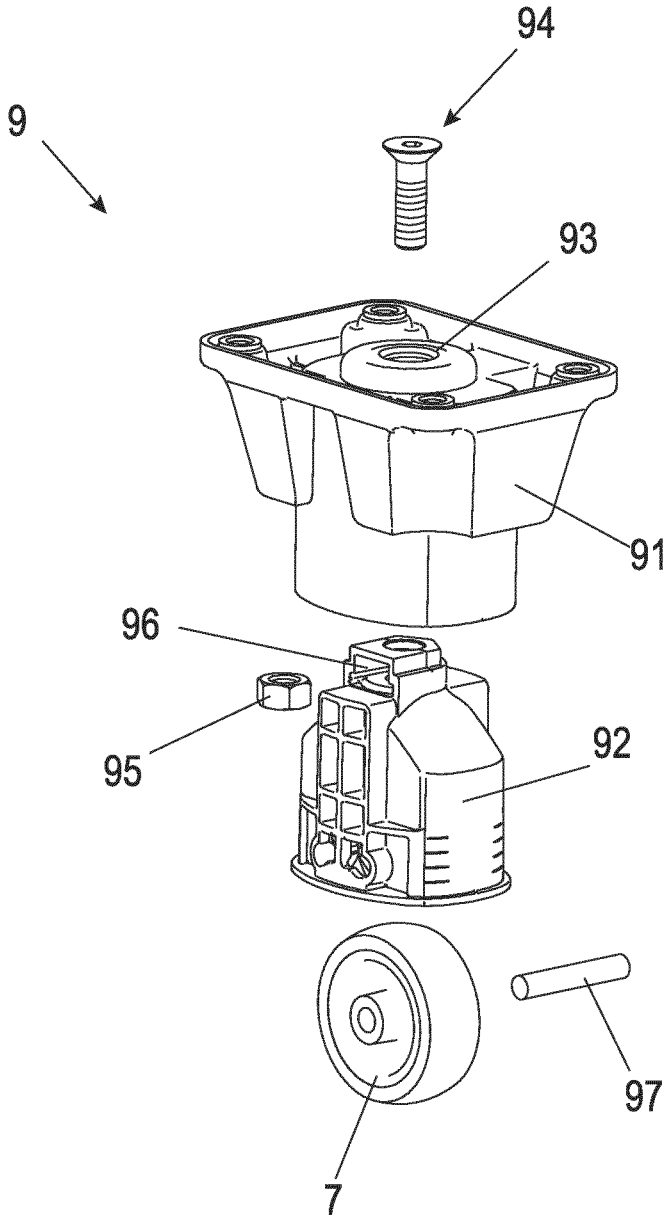

FIG. 10 shows a front view of the first fitting part of the embodiment variant according to FIG. 6 with the wall protection element attached to it, FIG. 11 shows a sectional enlargement of a detail of the suspension of the first fitting part on the second fitting part according to FIG. 10, FIGS. 12 and 13 show perspective views of a support element resting against the wall protection element and attached to a rear wall of the wall-mounted furniture piece, and FIG. 14 shows perspective exploded views of the support element shown in FIGS. 12 and 13.

DETAILED DESCRIPTION

In the following figure description, terms such as top, bottom, left, right, front, rear, etc. refer exclusively to the exemplary representation and position of the wall-mounted furniture piece, the fitting, the support element, the fitting part, the drive unit, etc. selected in the respective figures. These terms are not to be understood in a restrictive way, i.e. these references may change due to different working positions or mirror-symmetrical design or similar.

In FIGS. 1 and 6, the reference numeral 1 designates a wall-mounted furniture piece 1 in its entirety. The wall-mounted furniture piece 1 can be designed in particular as a wall-mounted cabinet that can be attached to a wall with the help of a fitting 2.

The wall-mounted furniture piece 1 has a furniture body with at least one base 12, at least one lateral wall 11, in the wall-mounted furniture piece 1 shown here designed as a wall-mounted cabinet two lateral walls 11 and at least one rear wall 13.

In all the exemplary embodiments shown, fitting 2 has a first fitting part 3, 8 that can be attached to the wall, a second fitting part 4 that can be attached to the wall-mounted furniture piece 1, and a length-adjustable drive unit 5, by means of which the first fitting part 3, 8 and the second fitting part 4 are interconnected and by means of which the wall-mounted furniture piece 1 can be adjusted to the desired vertical position on the wall.

The wall-mounted furniture piece 1 can be designed as a wall-mounted cabinet or wall unit, especially for living or cooking areas. It is also conceivable that such a wall-mounted furniture piece 1 could be designed as a base cabinet in the living, cooking, or sanitary area.

In order to avoid damage to the wall or rear side of the wall-mounted furniture piece 1 when carrying out the height positioning of the wall-mounted furniture piece 1, a support element 7 is arranged between the first fitting part 3 and the rear wall 13 of the wall-mounted furniture piece 1.

This support element 7 is preferably designed as a rolling element, especially as a roller. It is also conceivable to design such a support element 7 as a sliding element or cylindrical rolling element or the like.

It is important to allow the lowest possible frictional displacement of the wall-mounted furniture piece 1 using the support element 7 when adjusting the height of the wall-mounted furniture piece 1 using the fitting 2.

Based on FIGS. 1 to 5, a first embodiment variant of such a fitting 2 is explained below, in which the support element 7 is adjustably arranged on the first fitting part 3 orthogonally to the wall in a support direction x.

The drive unit 5 in the embodiment variant shown there is designed as a lifting column drive, especially as an electromechanical lifting column.

It is also conceivable to design such a drive unit 5 in another way, for example in the form of an energy storage device 51 in combination with a latching or locking unit designed as a latching fitting 52, as shown in FIG. 8 as an example.

As shown in FIGS. 2 and 3, the first fitting part 3 has a first lateral wall 35 that can be attached to the wall and a second lateral wall 32, which is arranged at an angle to the first lateral wall 35, in particular extending perpendicularly thereto, and on which the support element 7 is arranged.

The support element 7 can be attached directly to the second lateral wall 32. In the embodiment variant shown here, the support element 7 is attached to a sliding holder 33, wherein the sliding holder 33 is slidably fixed to the second lateral wall 32.

The sliding holder 33 is designed here in the form of a piece of sheet metal that is pushed onto a horizontally extending section of the second lateral wall 32. The sliding holder 33 has a slot 331 extending in horizontal direction through which a fixing element 34 is inserted which can fix the sliding holder 33 in a clamping manner.

Here, the fixing element 34 is designed in the form of a screw that clamps the sliding holder 33 to the second lateral wall 32 when tightened.

To facilitate exact positioning of the support element 7, a scale 332 is applied to the sliding holder 33.

In the embodiment variant shown here, the support element 7 is designed as a support roller that is firmly attached to the sliding holder 33. The support roller can be rotated via an axis aligned horizontally and parallel to the first lateral wall 35 so that the support element 7 can roll along the rear wall 13 of the wall-mounted furniture piece 1 when the wall-mounted furniture piece 1 is moved vertically.

The first lateral wall 35 has a large number of bores and/or oblong holes for securing the first fitting part 3 to a wall (not shown).

The first fitting part 3 also has a base 31 bent perpendicularly to the first lateral wall 35, on which the drive unit 5, here designed as an electromechanical lifting column, can be set up and fixed and which is additionally supported on the second lateral wall 32 by means of a welding lug 36.

At its upper end, the first fitting part 3 has a guide part 37 aligned parallel to base 31 with a central recess through which an upper end of drive unit 5 passes.

In the case of the drive unit 5 designed as an electromechanical lifting column, an inner column, which can be moved relative to an outer column, is connected to the second fitting part 4, wherein the second fitting part has a horizontally aligned plate that is preferably fixed to a ceiling of the wall-mounted furniture piece 1, so that by extending the lifting column the wall-mounted furniture piece 1 is raised accordingly.

In the embodiment variant shown in FIG. 2, the second fitting part 4 is additionally attached to the lateral wall 11, in this case to a counter plate 14 of the wall-mounted furniture piece 1 attached to the lateral wall 11, via a suspension element 226. The counter plate 14 serves to stabilize the lateral wall 11 and to fix the shortened rear wall 13 of the wall-mounted furniture piece 1.

To illustrate the setting of the support element 7 in support direction x. FIGS. 4 and 5 show two different positions of the sliding holder 33 on the second lateral wall 32 of the first fitting part 3. By moving the sliding holder 33 from the position shown in FIG. 4 to the position shown in FIG. 5, it is possible to adjust the tilting tendency of the wall-mounted furniture piece 1.

It is also conceivable to use the adjustability of this support element 7 to adapt the fitting 2 to rear walls of the wall-mounted furniture piece 1 that are of different thicknesses or in variable positions.

FIGS. 6 to 14 are used to describe further embodiment variants of a fitting 2 according to the invention.

In contrast to the embodiment variants described in FIGS. 1 to 5, in the embodiment variants shown in FIGS. 6 to 14 the support element 7 is attached to the rear wall 13, in this case to a rear wall that is greatly shortened in height, of wall-mounted furniture piece 1 and touches the first fitting part 8 when wall-mounted furniture piece 1 moves vertically.

In the embodiment variant shown in FIG. 6, the drive unit 5 is designed as an electromechanical lifting column, just as in the variants shown in FIGS. 1 to 5.

In contrast to the embodiment variant shown in FIGS. 2 and 3, the first fitting part 3 is designed here with a wall protection element 81, which extends along the wall to the side of the drive mounting part 82 that accommodates the drive unit 5.

The wall protection element 81 can be designed in one piece with the drive mounting part 82. In the embodiment variant shown here, the wall protection element 81 is coupled to the drive mounting part 82 via coupling elements 83.

Support element 7 is attached to the rear wall 13 of wall-mounted furniture piece 1 on a side of the rear wall 13 of wall-mounted furniture piece 1 opposite the wall protection element 81 in support direction x. Alternatively, the support element 7 can also be fixed to the base or one of the lateral walls via retainers and aligned with the rear area of the wall unit.

In the embodiment variant shown here, the support element 7 is included in a retaining element 9 shown in detail in FIG. 14.

It is advantageous to accommodate the support element 7 in the retaining element 9, since the retaining element 9 also allows variable positioning of the support element 7 in support direction x.

As shown in FIG. 14, the retaining element 9 essentially consists of a base body 91 in which a support element holder 92 is displaceably accommodated in support direction x.

The adjustment of the support element holder 92 in the base body 91 is carried out by means of an adjusting screw 94 in the screw seat 93 of the base body 91, which engages in a nut 95, which is firmly held in a nut holder 96 of the support element holder 92 in support direction x, so that by turning the adjusting screw 94 a displacement of the support element holder 92 relative to the base body 91 is achieved.

The support element 7 is accommodated in the support element holder 92, wherein a rotation axis 97 is fixed in the support element holder 92 for the rotatable mounting of the support element 7, which is here designed as a roller.

A tool holder for the adjusting screw 94 can be inserted through a bore 15 in the rear wall 13 from the front side of the wall-mounted furniture piece 1 so that the support element 7 can be adjusted in support direction x even after the wall-mounted furniture piece 1 has been hung on the wall.

FIG. 7 shows the configuration of the first fitting 8 to accommodate the drive unit 5, which is designed as a lifting column.

As can be seen in this figure, the first fitting part 8 is coupled via a linear guide 21 to a lateral wall 41 of the second fitting part 4 attached to the lateral wall 11 of the wall-mounted furniture piece 1.

The linear guide 21 is aligned in such a way that the first fitting part 8 is formed to be displaceable relative to the second fitting part 4 in a vertical direction z to each other.

Furthermore, a suspension element 22 is attached to the lateral wall 11, which comprises a hook that can be hooked into the second fitting part 4. The suspension element 22 serves to fix the wall-mounted furniture piece 1 to the second fitting part 4, wherein the wall-mounted furniture piece 1 with the suspension element 22 pre-mounted on it is hung into the second fitting part 6 and then adjusted with the aid of an adjustment unit accommodated in the suspension element 22.

FIG. 8 shows an alternative embodiment variant of such a first fitting part 8, which here does not have a base 87, since in this case the drive unit 5 is designed as an energy storage device 51 with a latching fitting 52 coupled thereto, which is attached to a second lateral wall 86, which is aligned parallel to the lateral wall 11 of the wall-mounted furniture piece 1 and coupled to the second fitting part 4 via the linear guide 21.

FIG. 9 shows another alternative embodiment variant of such a first fitting part 3, in which a spindle drive variant, which is open compared to the variant shown in FIG. 6, is included as drive unit 5.

In this embodiment variant, the second fitting part 4 has a drive coupling plate 42, which is coupled to the drive unit 5 at the upper end of the drive unit 5.

The second lateral wall 86 of the first fitting part 8 is also coupled here to the second fitting part 4 via a linear guide.

For this purpose, the second lateral wall 86 of the first fitting part 8 and the lateral wall 41 of the second fitting part 4 has longitudinal grooves 43, 87, in which sliding blocks 16 are guided, which are fixed in opposite directions in the lateral walls 41, 86, as also shown in FIGS. 10 and 11.

FIGS. 12 and 13 show again as individual illustrations the position of the support element 7 accommodated in the retaining element 9, resting on different vertical positions of the wall protection element 81 of the first fitting part, depending on the vertical positioning of the wall-mounted furniture piece 1.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Wall-mounted furniture piece
2 Lateral wall
3 Base
13 Rear wall
14 Counter plate
15 Bore
16 Sliding block
2 Fitting
21 Linear guide
22 Suspension element
3 First fitting part
31 Base
32 Second lateral wall
33 Sliding holder

331 Slot
332 Scale
34 Fixing element
35 First lateral wall
36 Welding lug
37 Guide part
4 Second fitting part
41 Lateral wall
42 Drive coupling plate
43 Guide groove
5 Drive unit
51 Energy storage device
52 Latching fitting
7 Support element
8 First fitting part
81 Wall protection element
82 Drive mounting part
83 Coupling element
85 First lateral wall
86 Second lateral wall
87 Guide groove
9 Retaining element
91 Base body
92 Support element holder
93 Screw seat
94 Adjusting screw
95 Nut
96 Nut holder
97 Axis
x Support direction
z Vertical direction

The invention claimed is:

1. A fitting for securing a wall-mounted furniture piece to a wall, wherein the wall-mounted furniture piece comprises a furniture body having at least one base, a lateral wall and a rear wall, wherein the fitting comprises:

a first fitting part that is directly fastenable to the wall;

a second fitting part that is directly fastenable to the wall-mounted furniture piece;

a length-adjustable drive unit, via which the first fitting part and the second fitting part are interconnected; and a support element is arranged between the first fitting part and the rear wall or a contact surface of the wall-mounted furniture piece arranged towards a rear region of the wall-mounted furniture piece, wherein the support element is adjustable orthogonally to the wall, wherein the support element is attached to the rear wall or a contact surface of the wall-mounted furniture piece arranged towards the rear region of the wall-mounted furniture piece, wherein the support element is accommodated in a retaining element attached to the rear wall or a contact surface arranged towards the rear region of the wall-mounted furniture piece, and wherein the retaining element has an adjustment unit for variable positioning of the support element.

2. The fitting of claim 1, wherein the support element is a rolling element or a sliding element.

3. The fitting of claim 1, wherein the length-adjustable drive unit is an electromechanical lifting column.

4. A wall-mounted furniture piece unit, comprising:

a furniture body having at least one base, at least one lateral wall and a rear wall; and a fitting for securing the wall-mounted furniture piece unit to a wall arranged on the base or the at least one lateral walls, wherein the fitting comprises a first fitting part that is directly fastenable to the wall;

a second fitting part that is directly fastened to the wall-mounted furniture piece;

a length-adjustable drive unit, via which the first fitting part and the second fitting part are interconnected; and a support element is arranged between the first fitting part and the rear wall or a contact surface of the wall-mounted furniture piece arranged towards a rear region of the wall-mounted furniture piece, wherein the support element is adjustable orthogonally to the wall, wherein the support element is attached to the rear wall or a contact surface of the wall-mounted furniture piece arranged towards the rear region of the wall-mounted furniture piece, wherein the support element is accommodated in a retaining element attached to the rear wall or a contact surface arranged towards the rear region of the wall-mounted furniture piece, and wherein the retaining element has an adjustment unit for variable positioning of the support element.

* * * * *